US011613872B2

(12) United States Patent
Doi

(10) Patent No.: US 11,613,872 B2
(45) Date of Patent: Mar. 28, 2023

(54) SLEWING CONTROL DEVICE FOR CONSTRUCTION MACHINE

(71) Applicant: KOBELCO CONSTRUCTION MACHINERY CO., LTD., Hiroshima (JP)

(72) Inventor: Takayuki Doi, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 885 days.

(21) Appl. No.: 16/466,381

(22) PCT Filed: Sep. 1, 2017

(86) PCT No.: PCT/JP2017/031510
§ 371 (c)(1),
(2) Date: Jun. 4, 2019

(87) PCT Pub. No.: WO2018/105180
PCT Pub. Date: Jun. 14, 2018

(65) Prior Publication Data

US 2020/0080285 A1 Mar. 12, 2020

(30) Foreign Application Priority Data

Dec. 8, 2016 (JP) ..... JP2016-238272

(51) Int. Cl.

| | |
|---|---|
| ***E02F 9/12*** | (2006.01) |
| ***E02F 9/20*** | (2006.01) |
| ***E02F 3/43*** | (2006.01) |
| ***E02F 9/22*** | (2006.01) |

(52) U.S. Cl.
CPC ..... *E02F 9/123* (2013.01); *E02F 9/2075* (2013.01); *E02F 3/43* (2013.01); *E02F 9/2025* (2013.01); *E02F 9/2095* (2013.01); *E02F 9/2296* (2013.01)

(58) Field of Classification Search
CPC .. B66C 23/84; E02F 3/43; E02F 9/123; E02F 9/2075; E02F 9/2025; E02F 9/2095; E02F 9/2296; E02F 9/20
(Continued)

(56) References Cited

U.S. PATENT DOCUMENTS

2007/0277986 A1 12/2007 Morinaga et al.
2008/0082240 A1* 4/2008 Kagoshima ..... E02F 9/123 701/50

(Continued)

FOREIGN PATENT DOCUMENTS

CN 105804146 A 7/2016
EP 2 628 857 A1 8/2013

(Continued)

OTHER PUBLICATIONS

Translation of JP-2009/068197.*

(Continued)

*Primary Examiner* — Geepy Pe
*Assistant Examiner* — Sean Patrick Reidy
(74) *Attorney, Agent, or Firm* — Oblon, McClelland, Maier & Neustadt, L.L.P.

(57) ABSTRACT

In a state where a slewing stop operation is input, in a first state where a slewing command value is equal to or greater than an actual slewing speed, a drive unit stops outputting a torque command value, and a free-run state occurs. In the first state, a command value calculation unit decreases the slewing command value at a first inclination. Meanwhile, in the state where the slewing stop operation is input, in a second state where the slewing command value is less than the actual slewing speed, the command value calculation unit decreases the slewing command value at a second inclination that is gentler than the first inclination.

4 Claims, 9 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2014/0145657 | A1* | 5/2014 | Takeo | E02F 9/123 318/400.21 |
| 2014/0147238 | A1 | 5/2014 | Izumi et al. | |
| 2014/0165548 | A1 | 6/2014 | Satake et al. | |
| 2014/0303855 | A1 | 10/2014 | Umeda et al. | |
| 2015/0184362 | A1 | 7/2015 | Komiyama | |

FOREIGN PATENT DOCUMENTS

| | | | |
|---|---|---|---|
| EP | 2 799 628 | A1 | 11/2014 |
| EP | 2 865 813 | A1 | 4/2015 |
| JP | 2005-273262 | A | 10/2005 |
| JP | 2009-68197 | A | 4/2009 |
| JP | 2009-127193 | A | 6/2009 |
| JP | 2009-293221 | A | 12/2009 |
| JP | 2011-94451 | A | 5/2011 |
| JP | 2014-58834 | A | 4/2014 |
| JP | 2016-125243 | A | 7/2016 |
| WO | WO 2006/054581 | A1 | 5/2006 |
| WO | WO 2013/099983 | A1 | 7/2013 |

OTHER PUBLICATIONS

Extended European Search dated Dec. 19, 2019 in European Patent Application No. 17877394.4, 6 pages.

International Search Report dated Dec. 5, 2017 in PCT/JP2017/031510 filed on Sep. 1, 2017.

* cited by examiner

SLEWING CONTROL DEVICE FOR CONSTRUCTION MACHINE

TECHNICAL FIELD

The present invention relates to a slewing control device for a construction machine that slews a slewing body by using a slewing motor.

BACKGROUND ART

Conventionally, in a construction machine including a slewing body, in order to implement smooth acceleration and deceleration, delay control is performed for gently increasing or decreasing an actual speed of a slewing motor toward a target speed at a time of acceleration and deceleration. As the delay control, trapezoidal control to bring the actual speed closer to the target speed at a fixed inclination and S-shaped control to bring the actual speed closer to the target speed at an inclination with an S-shaped curve are known.

Examples of conventional techniques to perform such delay control include Patent Literature 1. Patent Literature 1 discloses a technique to delay a drive command for driving an electric motor to be gently decreased as time passes when deceleration of the electric motor starts and to improve riding comfort when deceleration starts.

Meanwhile, the delay control is implemented by setting a slewing command value that gently decreases toward the target speed that is set at zero by inputting a slewing stop operation and performing feedback control on the slewing motor to cause a deviation between the set slewing command value and an implemented slewing speed to become zero.

In this way, since the slewing command value is gently decreased in the delay control, if the slewing stop operation is input under the situation where an actual slewing speed is lower than the target speed, the slewing command value becomes greater than the actual slewing speed for a period after the slewing stop operation is input. Particularly, when proportional control (P control) is applied as feedback control, the actual slewing speed is likely to be maintained lower than the target speed due to residual deviation, and if the slewing stop operation is input under this situation, the slewing command value becomes greater than the actual slewing speed for a while after this operation is input.

Here, when the slewing stop operation is input, an operator indicates intention to stop the slewing body, so there is no need to provide the slewing motor with acceleration torque. Therefore, in a construction machine, when the slewing command value is greater than the actual slewing speed in a state where the slewing stop operation is input, control to stop outputting a torque command value to the slewing motor is executed. Therefore, in this state, the construction machine goes into a free-run state where deceleration torque does not occur and the slewing body slews by inertial energy. The free-run state, which deteriorates the safety and riding comfort of the construction machine, is preferably kept as short as possible.

Although the delay control is implemented in Patent Literature 1 described above by gently decreasing the drive command, Patent Literature 1 does not have any description considering the free-run state, and thus has a problem that the free-run state cannot be shortened.

CITATION LIST

Patent Literature

Patent Literature 1: Japanese Patent Application Laid-Open No. 2009-293221

SUMMARY OF INVENTION

An object of the present invention is to provide a slewing control device that shortens the free-run state that occurs during braking of the slewing body and at the same time stops the slewing body smoothly.

A slewing control device according to one aspect of the present invention is a slewing control device for a construction machine including a slewing body and an operation unit to which an operation for slewing the slewing body is input. The slewing control device includes:

a slewing motor configured to drive the slewing body to slew;

a slewing inverter configured to drive the slewing motor;

a speed detection unit configured to detect an actual slewing speed of the slewing motor;

an operation amount detection unit configured to detect an operation amount that is input into the operation unit;

a target speed calculation unit configured to calculate a target speed according to the operation amount;

a command value calculation unit configured to calculate a slewing command value to cause the actual slewing speed to reach the target speed late at a predetermined inclination; and a drive unit configured to calculate a torque command value to cause a deviation between the slewing command value and the actual slewing speed to become zero and to output the torque command value to the slewing inverter.

The drive unit:

stops outputting the torque command value regardless of the deviation in a first state where the slewing command value is equal to or greater than the actual slewing speed in a state where the operation amount detection unit detects operation input of slewing stop; and outputs the torque command value in a second state where the slewing command value is less than the actual slewing speed in the state where the operation amount detection unit detects the operation input of the slewing stop.

The command value calculation unit decreases the slewing command value over time at a first inclination in the first state, and decreases the slewing command value over time at a second inclination that is gentler than the first inclination in the second state.

This configuration can shorten the period in which the slewing body is in the free-run state, and at the same time can stop the slewing body smoothly.

DESCRIPTION OF EMBODIMENTS

First Embodiment

An embodiment of the present invention will be described below with reference to the accompanying drawings. Note that the following embodiment is an example of embodying the present invention, and does not intend to limit the technical scope of the present invention.

Figure 1:
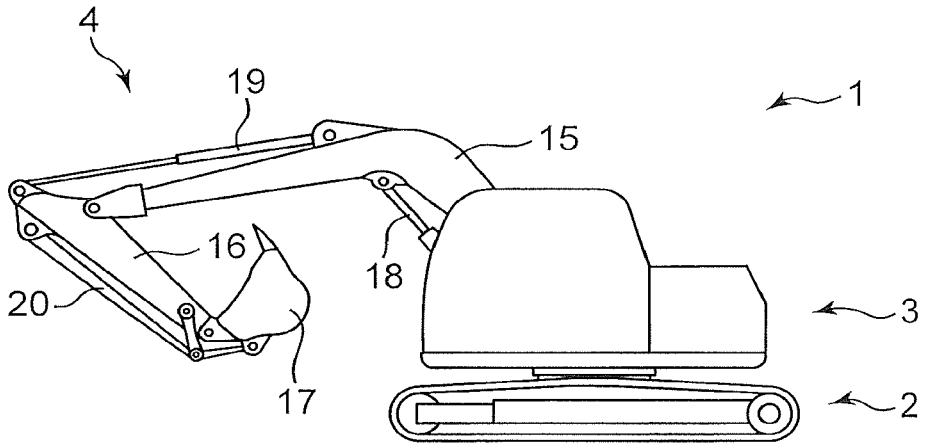
FIG. 1 is an external view of a construction machine to which a slewing control device according to an embodiment of the present invention is applied.

FIG. 1 is an external view of a construction machine 1 to which a slewing control device according to the embodiment of the present invention is applied. The construction machine 1 includes a hybrid excavator, but this is one example, and the construction machine 1 may include an excavator such as a hydraulic excavator. Also, as the construction machine 1, any construction machine may be employed as long as the construction machine includes a slewing body such as a crane.

The construction machine 1 includes a crawler type lower traveling body 2, an upper slewing body 3 provided on the lower traveling body 2 in a slewable manner (one example of a slewing body), and a work device 4 attached to the upper slewing body 3.

The work device 4 includes a boom 15 attached to the upper slewing body 3 such that the boom 15 can rise and fall, an arm 16 swingably attached to a tip portion of the boom 15, and a bucket 17 swingably attached to a tip portion of the arm 16.

Also, the work device 4 includes a boom cylinder 18 for causing the boom 15 to rise and fall with respect to the upper slewing body 3, an arm cylinder 19 for swinging the arm 16 with respect to the boom 15, and a bucket cylinder 20 for swinging the bucket 17 with respect to the arm 16. The upper slewing body 3 includes a cabin to which an operator gets aboard.

Figure 2:
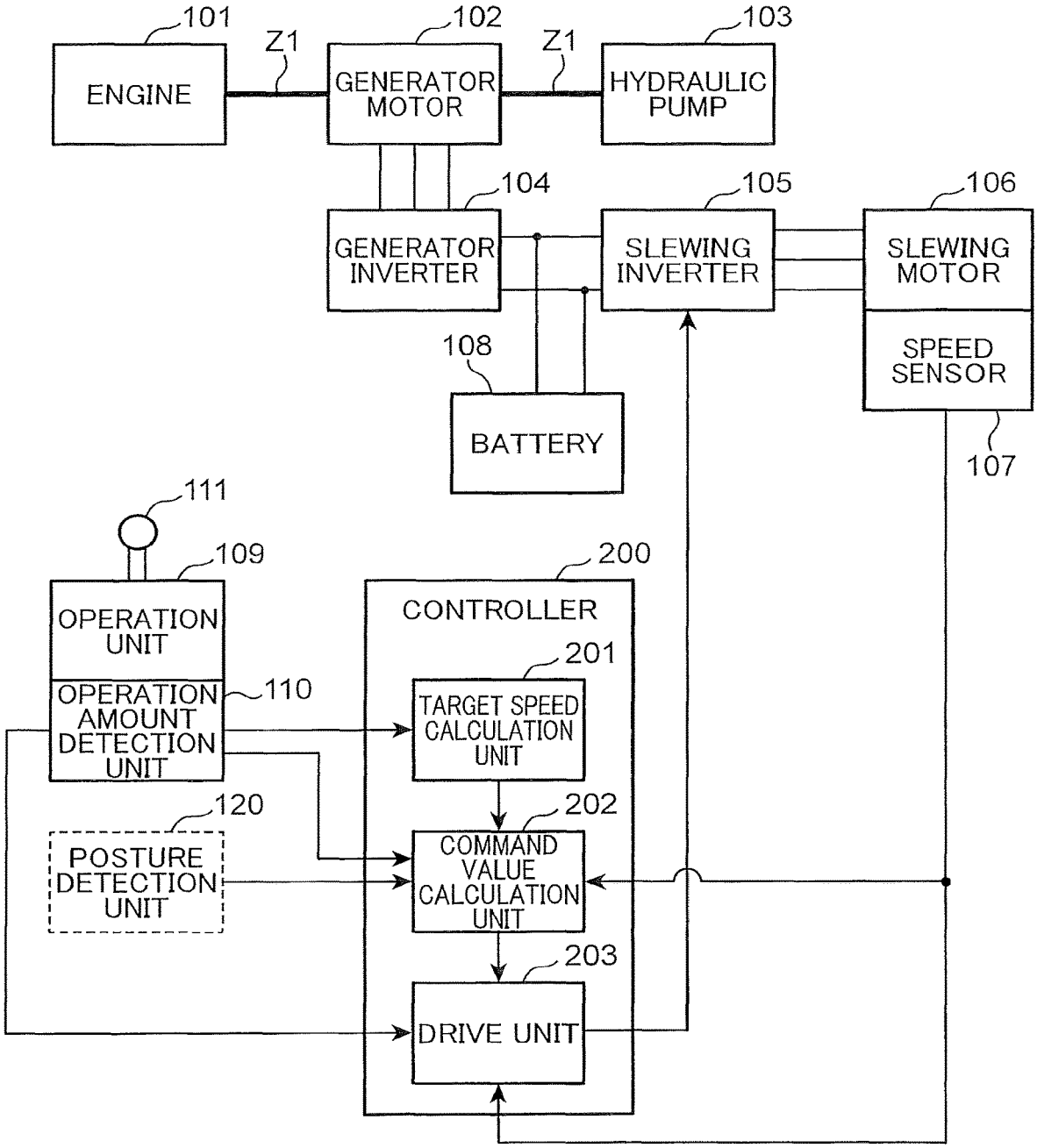
FIG. 2 is a block diagram showing one example of a system configuration of the construction machine shown in FIG. 1.

FIG. 2 is a block diagram showing one example of a system configuration of the construction machine 1 shown in FIG. 1. The construction machine 1 includes an engine 101, a generator motor 102 and a hydraulic pump 103 that are connected to a drive shaft Z1 of the engine 101, a generator inverter 104 for controlling charging and discharging of a battery 108 and driving of the generator motor 102, a slewing inverter 105 for controlling charging and discharging of the battery 108 and driving of a slewing motor 106, the slewing motor 106 for slewing the upper slewing body 3, the battery 108 capable of charging electric power generated by the generator motor 102 and the slewing motor 106, an operation unit 109 into which an operation of an operator is input, an operation amount detection unit 110 for detecting an operation amount of the operation unit 109, and a controller 200 for controlling the construction machine 1. Note that in FIG. 2, the slewing inverter 105, the slewing motor 106, a speed sensor 107, the operation unit 109, the operation amount detection unit 110, and the controller 200 constitute the slewing control device.

The engine 101 includes, for example, a diesel engine. The generator motor 102 functions as a generator by motive power of the engine 101, and converts the motive power of the engine 101 into electric power. Also, the generator motor 102 functions as an electric motor by electric power from the battery 108, and assists the engine 101.

The hydraulic pump 103 is driven by the motive power of the engine 101 and discharges an operating oil. The operating oil discharged from the hydraulic pump 103 is supplied to the cylinders, from the boom cylinder 18 to the bucket cylinder 20 shown in FIG. 1, via a control valve (not shown).

The generator inverter 104 includes, for example, a three-phase inverter, and stores the electric power converted by the generator motor 102 in the battery 108. Also, the generator inverter 104 controls switching between the function as a generator of the generator motor 102 and the function as an electric motor of the generator motor 102. Also, under the control of the controller 200, the generator inverter 104 controls torque of the generator motor 102.

The slewing inverter 105 includes, for example, a three-phase inverter, supplies the electric power of the battery 108 to the slewing motor 106, and drives the slewing motor 106. Also, the slewing inverter 105 stores, in the battery 108, regenerative power generated in the slewing motor 106 when slewing of the upper slewing body 3 is decelerated. Also, the slewing inverter 105 generates a three-phase PWM signal in accordance with a torque command value that is output from a drive unit 203 and outputs the three-phase PWM signal to the slewing motor 106.

The slewing motor 106 is driven by the electric power of the battery 108 and slews the upper slewing body 3 shown in FIG. 1.

The battery 108 stores the electric power generated by the generator motor 102 under the control of the generator inverter 104. Also, the battery 108 stores the regenerative power of the slewing motor 106 under the control of the slewing inverter 105.

The speed sensor 107 includes, for example, a rotary encoder for detecting a rotation angle of a rotor, and a processor for calculating a rotation speed of the slewing motor 106 by differentiating the detected rotation angle. Then, the speed sensor 107 detects the rotation speed of the slewing motor 106 calculated by the processor as an actual slewing speed of the upper slewing body 3.

The operation unit 109 includes, for example, an operation lever 111 and receives the operation by the operator for slewing the upper slewing body 3. Here, the operation unit 109 changes pilot pressure in accordance with a tilt angle of the operation lever 111. The operation lever 111 is configured, for example, to be tilted in a left and right direction. For slewing the upper slewing body 3 in the right direction, for example, the operation lever 111 is tilted in the right direction, and for slewing the upper slewing body 3 in the left direction, the operation lever 111 is tilted in the left direction. Also, a certain angular range including a tilt amount of 0 is set as a neutral range for the operation lever 111.

The operation amount detection unit 110 includes, for example, a hydraulic sensor, and detects the operation amount of the operation unit 109 by using the pilot pressure that changes in accordance with the tilt amount of the operation lever 111. Specifically, as the rightward tilt amount of the operation lever increases beyond the neutral range, the operation amount detection unit 110 increases the operation amount, for example, in a positive direction. As the leftward tilt amount of the operation lever increases beyond the neutral range, the operation amount detection unit 110 increases the operation amount, for example, in a negative direction. Here, the operation amount detection unit 110 may include a potentiometer. Note that when the operation lever 111 is returned to the neutral range from a position other than the neutral range, the operation amount detection unit 110 detects that the slewing stop operation is input.

The controller 200 includes, for example, a computer including components such as a dedicated processor such as an application specific integrated circuit (ASIC) or a field-programmable gate array (FPGA), or a CPU, a rewritable ROM, and a RAM.

The controller 200 includes a target speed calculation unit 201, a command value calculation unit 202, and the drive unit 203.

The target speed calculation unit 201 calculates a target speed of the upper slewing body 3 in accordance with the operation amount detected by the operation amount detection unit 110. Here, as the operation amount increases in a positive direction, the target speed calculation unit 201 increases the target speed in the positive direction, for example, linearly. As the operation amount increases in a negative direction, the target speed calculation unit 201 increases the target speed in the negative direction, for example, linearly.

The command value calculation unit 202 calculates a slewing command value for implementing delay control to cause an actual rotation speed to reach the target speed late at a predetermined inclination. Here, as the delay control, trapezoidal control to increase or decrease the slewing command value toward the target speed at a linear inclination, or S-shaped control to increase or decrease the slewing command value toward the target speed at an S-shaped inclination can be employed.

Figure 3:
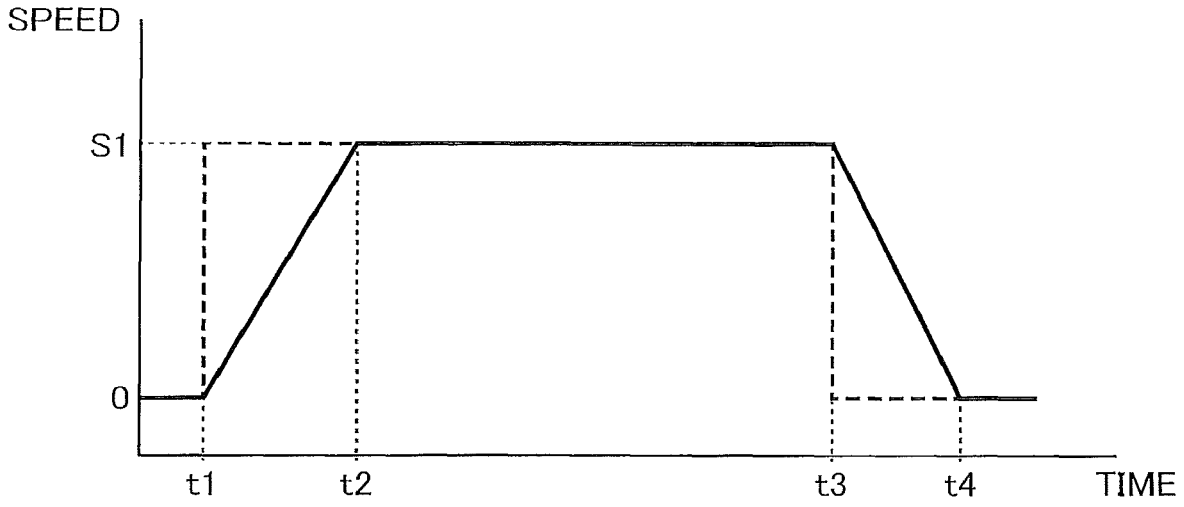
FIG. 3 is a graph showing temporal transition of a slewing command value when trapezoidal control is employed.

FIG. 3 is a graph showing temporal transition of the slewing command value when the trapezoidal control is employed. The vertical axis indicates speed and the horizontal axis indicates time. In FIG. 3, the dotted line indicates the target speed and the solid line indicates the slewing command value. In this example, an operation is input in which the operation lever 111 is tilted at a certain tilt amount at time t1, the operation lever 111 is held at this tilt amount in a period from time t1 to time t3, and the operation lever 111 is returned to the neutral range at time t3. Therefore, the target speed increases from zero to a value S1 at time t1, maintains the value S1 in the period from time t1 to t3, and decreases from the value S1 to zero at time t3.

Meanwhile, the slewing command value gently increases from zero to the value S1 at a linear inclination over the period from time t1 to t2. Also, the slewing command value gently decreases from the value S1 to zero at a linear inclination over the period from time t3 to t4. Accordingly, the slewing motor 106 gradually increases or decreases the actual slewing speed, thereby improving safety and riding comfort.

Figure 4:
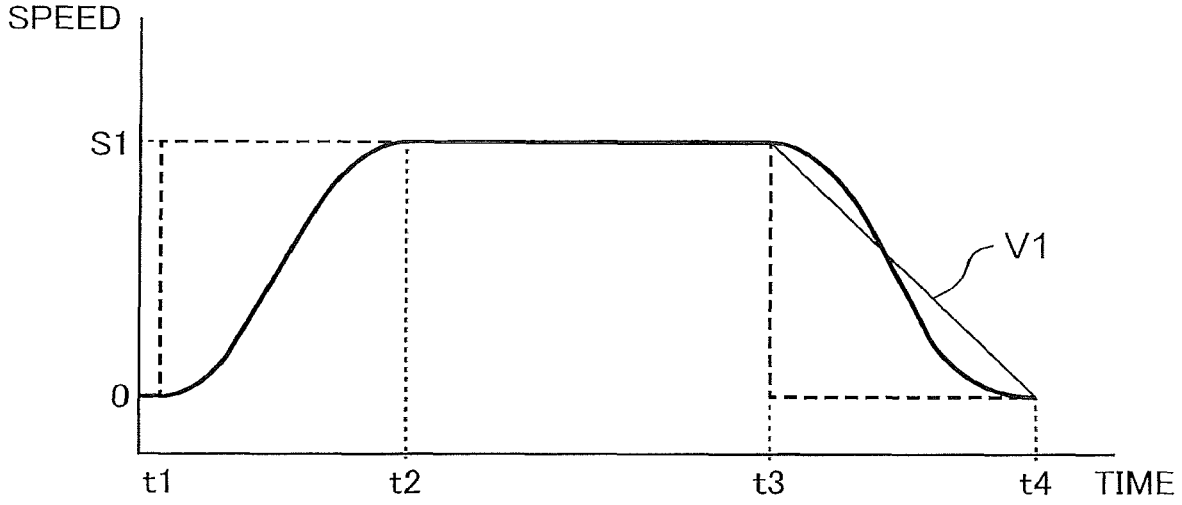
FIG. 4 is a graph showing temporal transition of the slewing command value when S-shaped control is employed.

FIG. 4 is a graph showing temporal transition of the slewing command value when the S-shaped control is employed. The vertical axis indicates speed and the horizontal axis indicates time. In FIG. 4, the dotted line indicates the target speed and the solid line indicates the slewing command value. In FIG. 4, the same operation as in FIG. 3 is input. FIG. 4 differs from FIG. 3 in that the slewing command value increases (time t1 to t2) or decreases (time t3 to t4), not linearly but in an S shape. In detail, the slewing command value changes while drawing a gentle curve in the period from time t1 to time t2 and the period from time t3 to time t4, and changes more smoothly than in FIG. 3. Hereinafter, a case where the trapezoidal control is applied as the delay control will be described as an example.

Figure 5:
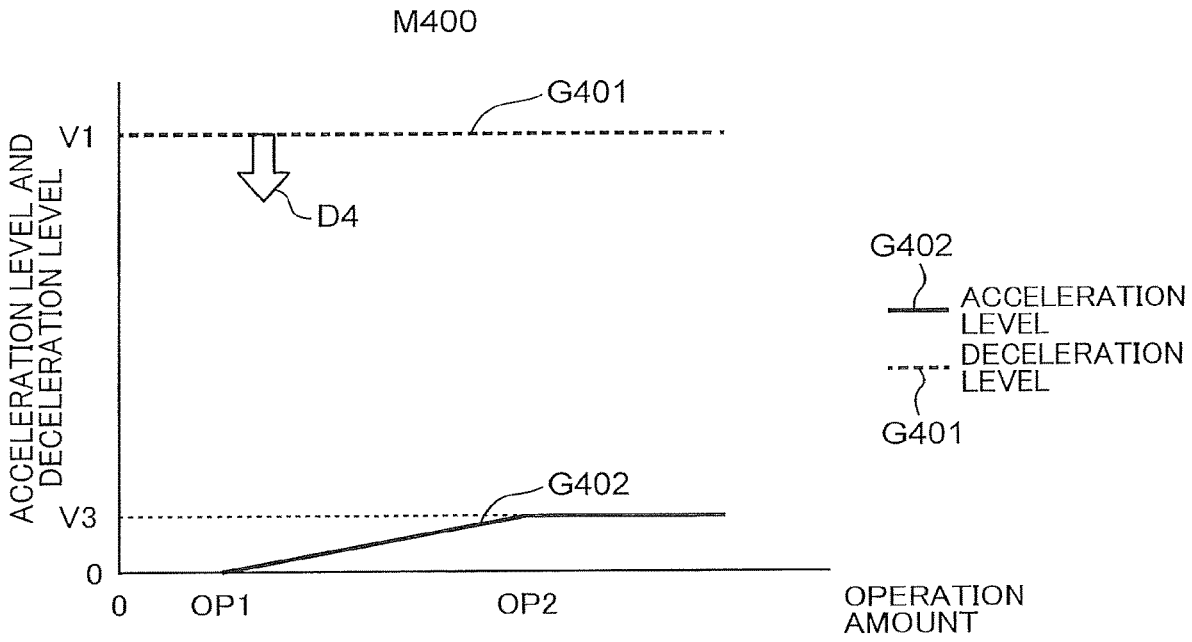
FIG. 5 is a graph showing a first map.
Figure 6:
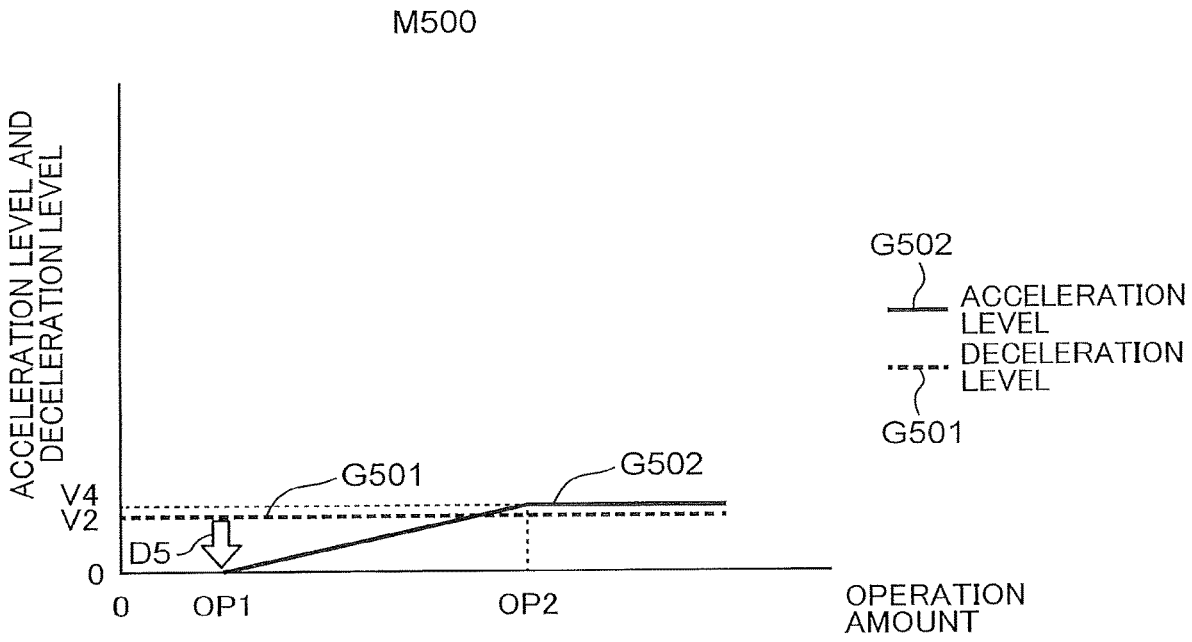
FIG. 6 is a graph showing a second map.

Reference is returned to FIG. 2. The command value calculation unit 202 calculates the slewing command value by using a first map M400 and a second map M500. FIG. 5 is a graph showing the first map M400. The vertical axis indicates the acceleration level and deceleration level, and the horizontal axis indicates the operation amount. FIG. 6 is a graph showing the second map M500. The vertical axis indicates the acceleration level and deceleration level, and the horizontal axis indicates the operation amount. Note that the first and second maps M400 and M500 are stored in advance in a storage device such as a ROM.

The first map M400 is used when the slewing command value is equal to or greater than the actual slewing speed. The second map M500 is used when the slewing command value is less than the actual slewing speed. Both the first and second maps M400 and M500 have deceleration inclination characteristics G401 and G501 indicating the acceleration level of the slewing command value during deceleration, and acceleration inclination characteristics G402 and G502 indicating the acceleration level of the slewing command value at a time of acceleration.

Both of the deceleration inclination characteristics G401 and G501 maintain constant values V1 and V2 regardless of the operation amount. The value V1 is set at a value that is significantly greater than the value V2. In the examples of FIGS. 5 and 6, the value V1 is set at a value approximately eight times the value V2, but this is one example. Accordingly, in a state where the operation amount detection unit 110 detects input of the operation indicating slewing stop, in a first state where the slewing command value is equal to or greater than the actual slewing speed, the slewing command value decreases toward the target speed at an inclination of the value V1. On the other hand, in the state where the operation amount detection unit 110 detects input of the operation indicating slewing stop, in a second state where the slewing command value is less than the actual slewing speed, the slewing command value decreases toward the target speed at an inclination of the value V2. That is, in the first state, the slewing command value decreases at a steeper inclination than in the second state. A reason for this will be described later.

Values of both of the acceleration inclination characteristics G402 and G502 start increasing when the operation amount exceeds OP1, increase at a constant inclination in sections where the operation amount is from OP1 to OP2, and remain at constant values V3 and V4 when the operation amount exceeds OP2. Here, the value V4 is somewhat greater than the value V3, but is set at almost the same value as the value V3.

Accordingly, at a time of acceleration, regardless of whether the slewing command value is equal to or greater than the actual slewing speed, in the section where the operation amount is from OP1 to OP2, as the operation amount increases, the slewing command value increases toward the target speed at a greater inclination. When the operation amount exceeds OP2, the slewing command value increases toward the target speed at the inclinations of V3 and V4. Accordingly, until the operation amount exceeds OP2, it is possible to provide the operator with an operation feeling that the acceleration level increases as the operation amount increases.

Reference is returned to FIG. 2. The drive unit 203 calculates the torque command value such that a deviation between the slewing command value and the actual slewing speed becomes zero, outputs the torque command value to the slewing inverter 105, and performs feedback control on the slewing motor 106.

Here, the drive unit 203 employs proportional control as the feedback control. This is because it is taken into consideration that, when proportional integral control (PI control) is employed, the deviation is accumulated and thus response of positioning of the upper slewing body 3 deteriorates. However, employing proportional control increases the possibility that the actual slewing speed will be maintained lower than the target speed due to the effect of residual deviation.

Also, in the state where the operation amount detection unit 110 detects input of the operation indicating slewing stop, in the first state where the slewing command value is equal to or greater than the actual slewing speed, the drive unit 203 stops outputting the torque command value regardless of the deviation.

On the other hand, in the state where the operation amount detection unit 110 detects input of the operation indicating slewing stop, in the second state where the slewing command value is less than the actual slewing speed, the drive unit 203 outputs the torque command value.

In feedback control, when the slewing command value is equal to or greater than the actual slewing speed, the torque command value for increasing the torque of the slewing motor 106 is output. However, when inputting the slewing stop operation, the drive unit 204 does not need to increase the torque because the operator indicates intention to stop slewing. Therefore, the drive unit 203 stops outputting the torque command value in the first state. However, in the first state, the slewing motor 106 is no longer under torque control, and thus the upper slewing body 3 goes into a free-run state of slewing by inertial energy.

Figure 7:
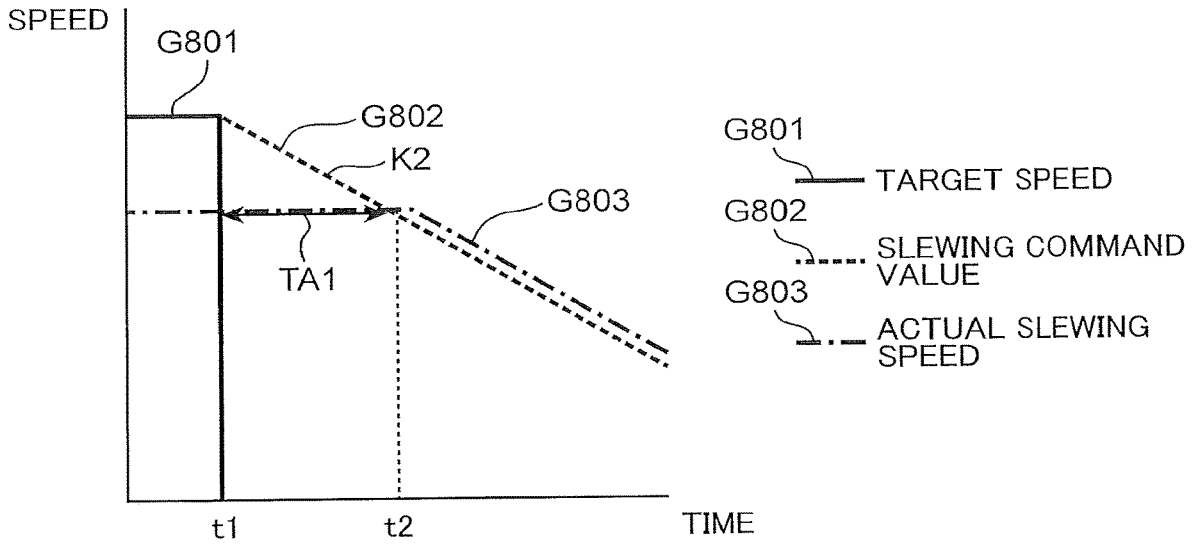
FIG. 7 is a graph describing a free-run state in a slewing control device of a comparative example.

FIG. 7 is a graph describing the free-run state in the slewing control device of a comparative example. The vertical axis indicates the slewing speed and the horizontal axis indicates time. Here, it is assumed that the slewing control device of the comparative example determines the inclination of the slewing command value by using only the second map M500 shown in FIG. 6 without using the first map M400 shown in FIG. 5.

In FIG. 7, the graph G801 shows the target speed, the graph G802 shows the slewing command value, and the graph G803 shows the actual slewing speed. In this example, the actual slewing speed is maintained lower than the target speed before time t1. This is due to the influence of residual deviation of proportional control.

At time t1, since the operation lever 111 is returned to the neutral range and the slewing stop operation is input, the operation amount becomes zero and the target speed becomes zero. At this time, to implement trapezoidal control, the slewing command value decreases at a second inclination K2. Also, due to the influence of residual deviation, the actual slewing speed is lower than the slewing command value.

The period TA1 from time t1 to t2 is the first state in which the slewing command value is equal to or greater than the actual slewing speed in a state where the slewing stop operation is input. Therefore, the output of the torque command value is stopped. Accordingly, the upper slewing body 3 goes into a free-run state in the period TA1.

At time t2, in the state where the slewing stop operation is input, since the slewing command value becomes less than the actual slewing speed, which is the second state, the output of the torque command value is started. After that, the actual slewing speed decreases following the slewing command value.

In this way, the slewing control device of the comparative example has a problem that the free-run state indicated by the period TA1 is prolonged because the slewing command value decreases at a constant inclination regardless of magnitude relationship between the slewing command value and the actual slewing speed.

Figure 8:
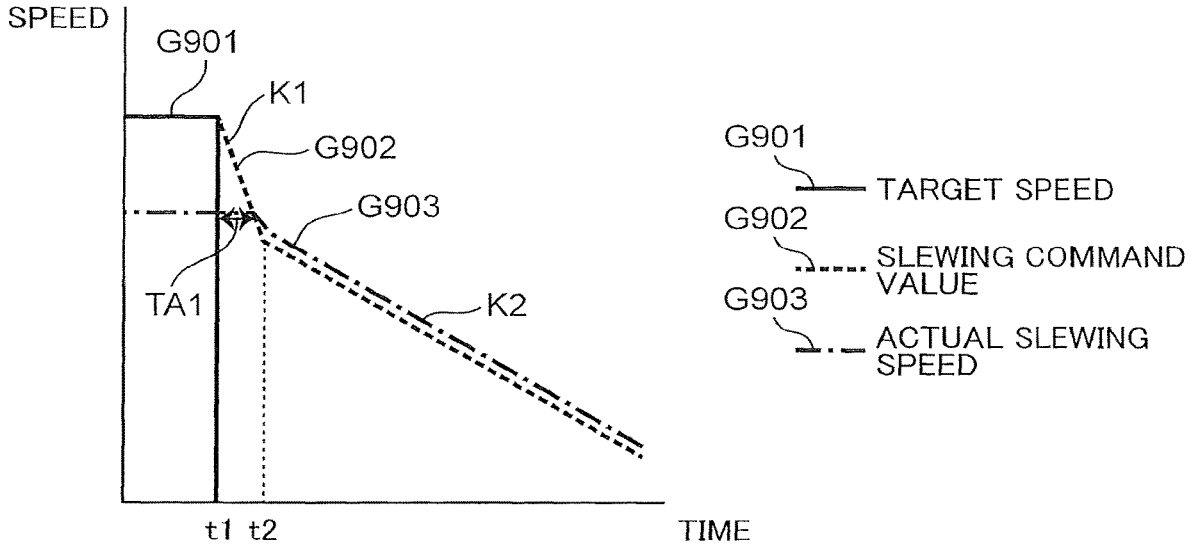
FIG. 8 is a graph describing the free-run state in the slewing control device according to the embodiment of the present invention.

Therefore, the slewing control device of the present embodiment employs the following configuration. FIG. 8 is a graph describing the free-run state in the slewing control device according to the embodiment of the present invention. The relationship between the vertical axis and the horizontal axis is the same as in FIG. 7. In FIG. 8, the graph G901 shows the target speed, the graph G902 shows the slewing command value, and the graph G903 shows the actual slewing speed. Also, the scene assumed in FIG. 8 is the same as in FIG. 7. Therefore, the free-run state occurs in the period TA1.

FIG. 8 differs from FIG. 7 in that as shown in the graph G902, the inclination of the slewing command value in the period TA1 from time t1 to time t2 is greater than the inclination of the slewing command value after time t2.

That is, in the present embodiment, in a state where the operation amount detection unit 110 detects the input of slewing stop operation, in the first state where the slewing command value is equal to or greater than the actual slewing speed, the command value calculation unit 202 refers to the deceleration inclination characteristic G401 of the first map M400 and decreases the slewing command value at a first inclination K1 defined by the value V1. This implements shortening of the period TA1 of the free-run state. On the other hand, in the state where the operation amount detection unit 110 detects the input of slewing stop operation, in the second state where the slewing command value is less than the actual slewing speed, the command value calculation unit 202 refers to the deceleration inclination characteristic G501 of the second map M500 and decreases the slewing command value at the second inclination K2 defined by the value V2 (<V1).

Figure 9:
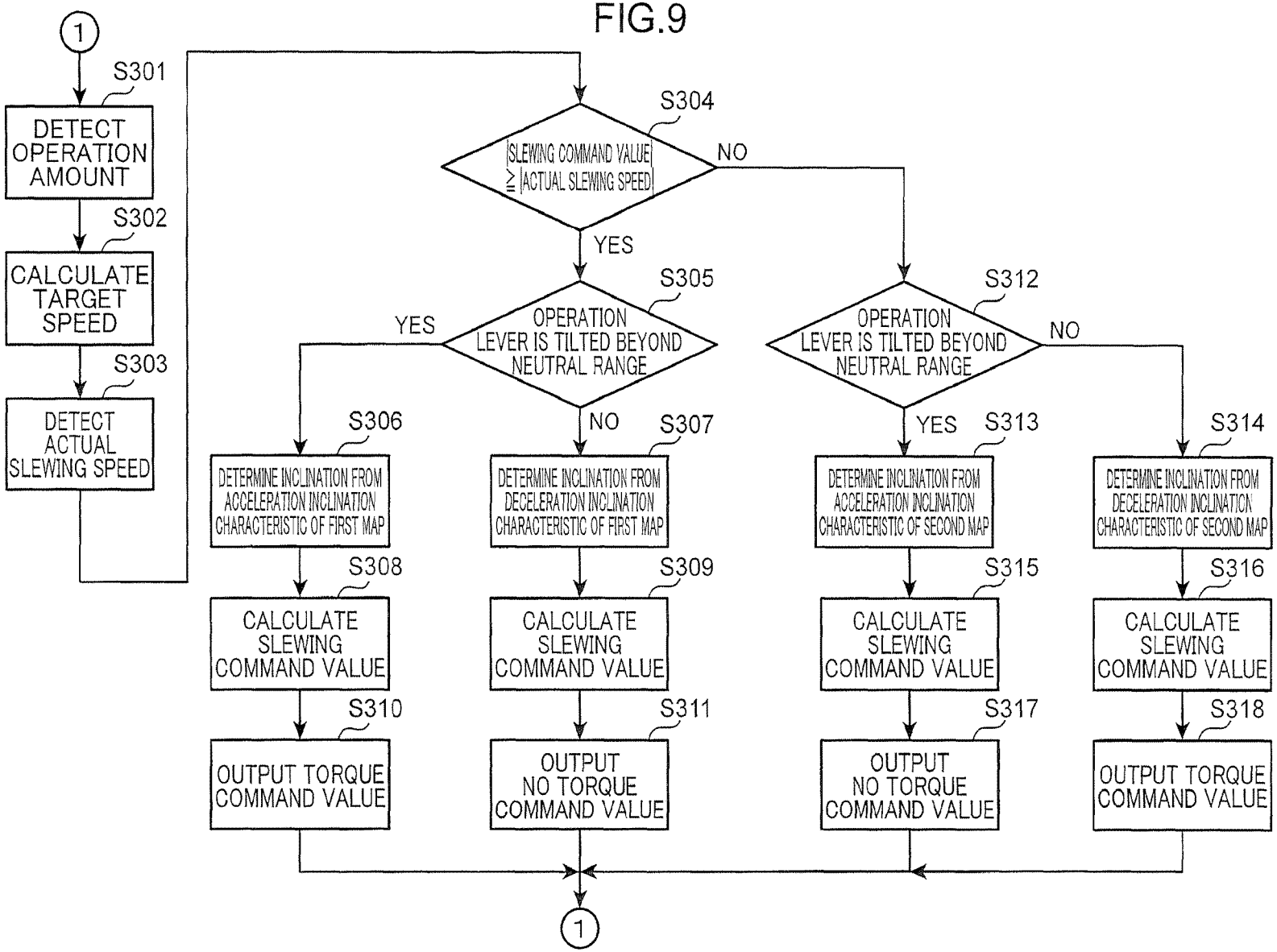
FIG. 9 is a flowchart showing an operation of the slewing control device in the embodiment of the present invention.

Next, an operation of the slewing control device in the embodiment of the present invention will be described. FIG. 9 is a flowchart showing the operation of the slewing control device in the embodiment of the present invention.

This flowchart is repeatedly executed, for example, from the start of driving the engine 101 until the driving of the engine 101 is stopped.

In S301, the operation amount detection unit 110 detects the operation amount of the operation unit 109. For example, when the operation lever 111 enters the neutral range, the operation amount of zero is detected, and when the operation lever 111 is tilted beyond the neutral range, the operation amount corresponding to the tilt amount is detected.

Next, the target speed calculation unit 201 calculates the target speed according to the operation amount detected in S301 (S302). For example, if the operation amount of zero is detected, the target speed of zero is set.

Next, the speed sensor 107 detects the actual slewing speed (S303). Next, if an absolute value of the slewing command value is equal to or greater than an absolute value of the actual slewing speed (YES in S304), the command value calculation unit 202 determines whether the operation lever 111 is tilted beyond the neutral range (S305). In this case, if the operation amount detected by the operation amount detection unit 110 is not zero, the command value calculation unit 202 may determine that the operation lever 111 is tilted beyond the neutral range. If the operation amount detected by the operation amount detection unit 110 is zero, the command value calculation unit 202 may determine that the operation lever 111 is not tilted beyond the neutral range. Note that the absolute value of the slewing command value is compared with the absolute value of the actual slewing speed because it is considered that positive and negative of the actual slewing speed of the upper slewing body 3 is reversed between right slewing and left slewing. Also, as a default value of the slewing command value, for example, 0 is employed.

Next, if the command value calculation unit 202 determines that the operation lever is tilted beyond the neutral range (YES in S305), the operator indicates intention to accelerate, and the absolute value of the slewing command value is greater than the absolute value of the actual slewing speed. Therefore, the command value calculation unit 202 determines the inclination of the slewing command value from the acceleration inclination characteristic G402 of the first map M400 (S306). In this case, the acceleration level corresponding to the operation amount detected by the operation amount detection unit 110 is determined from the acceleration inclination characteristic G402, and the inclination defined by the determined acceleration level is determined as the inclination of the slewing command value.

Next, the command value calculation unit 202 calculates the slewing command value by using the inclination determined in S306 (S308). Here, if the current target speed is greater than the current slewing command value, the command value calculation unit 202 may calculate the slewing command value by adding a value obtained by multiplying the inclination determined in S306 by the unit time to the current slewing command value. As the unit time, a cycle of one loop of the flowchart of FIG. 9, that is, a calculation cycle of the slewing command value can be employed. Accordingly, trapezoidal control as shown in the period from time t1 to time t2 in FIG. 3 is implemented. Note that the command value calculation unit 202 maintains the current slewing command value if the current target speed is equal to the current slewing command value.

Next, the drive unit 203 calculates the torque command value such that the deviation between the slewing command value calculated in S308 and the actual slewing speed becomes zero, and outputs the torque command value to the slewing inverter 105 (S310), then returns the process to S301.

On the other hand, if the operation lever 111 is not tilted beyond the neutral range in S305 (NO in S305), this corresponds to the above-described first state, that is, the operator indicates intention to stop slewing and the absolute value of the slewing command value is greater than the absolute value of the actual slewing speed. Therefore, the command value calculation unit 202 determines the inclination of the slewing command value from the deceleration inclination characteristic G401 of the first map M400 (S307). Here, the first inclination K1 (FIG. 8) defined by the value V1 of the deceleration inclination characteristic G401 is determined as the inclination of the slewing command value.

Next, the command value calculation unit 202 calculates the slewing command value by using the first inclination K1 determined in S307 (S309). Here, if the current slewing command value is greater than the current target speed, the command value calculation unit 202 may calculate the slewing command value by subtracting a value obtained by multiplying the first inclination K1 by the unit time from the current slewing command value. Accordingly, as shown in the period TA1 in FIG. 8, the slewing command value decreases toward the target speed at the first inclination K1. Note that the command value calculation unit 202 maintains the current slewing command value if the current target speed is equal to the current slewing command value.

Next, since this corresponds to the first state, the drive unit 203 does not output the torque command value regardless of the deviation between the slewing command value and the actual slewing speed (S311), and returns the process to S301. Accordingly, the upper slewing body 3 goes into a free-run state.

In S304, if the absolute value of the slewing command value is less than the absolute value of the actual slewing speed (NO in S304), the command value calculation unit 202 determines whether the operation lever 111 is tilted beyond the neutral range as in S305 (S312).

Next, if the command value calculation unit 202 determines that the operation lever 111 is tilted beyond the neutral range (YES in S312), the operator indicates intention to accelerate, and the absolute value of the slewing command value is less than the absolute value of the actual slewing speed. Therefore, the command value calculation unit 202 determines the inclination of the slewing command value from the acceleration inclination characteristic G502 of the second map M500 (S313). In this case, the acceleration level is determined in accordance with the operation amount detected by the operation amount detection unit 110 from the acceleration inclination characteristic G502, and the inclination specified by the determined acceleration level is determined as the inclination of the slewing command value.

Next, the command value calculation unit 202 calculates the slewing command value by using the inclination determined in S313 (S315). Here, if the current target speed is greater than the current slewing command value, the command value calculation unit 202 may calculate the slewing command value by adding a value obtained by multiplying the inclination determined in S313 by the unit time to the current slewing command value. Note that the command value calculation unit 202 maintains the current slewing command value if the current target speed is equal to the current slewing command value.

Next, the operator indicates intention to accelerate, but the absolute value of the slewing command value is less than the absolute value of the actual slewing speed. Therefore, the drive unit 203 does not output the torque command value (S317) regardless of the deviation between the slewing command value and the actual slewing speed, and returns the process to S301.

On the other hand, if the operation lever 111 is not tilted beyond the neutral range in S312 (NO in S312), this corresponds to the above-mentioned second state, that is, the operator indicates intention to stop slewing, and the absolute value of the slewing command value is less than the absolute value of the actual slewing speed. Therefore, the command value calculation unit 202 determines the inclination of the slewing command value from the deceleration inclination characteristic G501 of the second map M500 (S314). In this case, the second inclination K2 defined by the value V2 of the deceleration inclination characteristic G501 of the second map M500 is determined as the inclination of the slewing command value.

Next, the command value calculation unit 202 calculates the slewing command value by using the second inclination K2 determined in S314 (S316). Here, if the current slewing command value is greater than the current target speed, the command value calculation unit 202 may calculate the slewing command value by subtracting a value obtained by multiplying the second inclination K2 by the unit time from the current slewing command value. Accordingly, as shown at time t2 and thereafter in FIG. 8, the slewing command value decreases at the second inclination K2 toward the target speed. Note that the command value calculation unit 202 maintains the current slewing command value if the current target speed is equal to the current slewing command value.

Next, the drive unit 203 calculates the torque command value such that the deviation between the actual slewing speed and the slewing command value becomes zero, outputs the torque command value to the slewing inverter 105 (S318), and returns the process to S301. Accordingly, the slewing motor 106 undergoes feedback control.

In this way, according to the present embodiment, the slewing command value decreases at the first inclination K1 in the state where the slewing command value is equal to or greater than the actual slewing speed (first state) while the operation indicating slewing stop is input. Therefore, the period TA1 of the free-run state can be shortened.

Note that the present embodiment has described a case of using trapezoidal control as the delay control as an example, but the S-shaped control may be used as the delay control. For example, in the first state, the command value calculation unit 202 determines the value V1 from the first map M400. Here, as shown in FIG. 4, the value V1 specifies the average inclination when the target speed decreases. Therefore, the command value calculation unit 202 may correct the value V1 to fit the predetermined S shape in accordance with elapsed time since the current target speed is set, and the modified value may be set as the first inclination K1. Note that the second inclination K2 when S-shaped control is applied may also be determined similarly to the first inclination K1. Also, the inclination at a time of increase when S-shaped control is applied may be determined similarly to the first inclination K1.

Second Embodiment

The second embodiment makes first and second inclinations K1 and K2 gentle as an actual slewing speed decreases. Note that in the present embodiment, the same components as in the first embodiment are denoted with the same reference signs, and the description is omitted.

Specifically, when determining the first inclination K1, as the actual slewing speed decreases, a command value calculation unit 202 translates a deceleration inclination characteristic G401 shown in FIG. 5 in a direction indicated by an arrow D4, decreases a value V1, and corrects the deceleration inclination characteristic G401. Then, the command value calculation unit 202 determines the value V1 by using the corrected deceleration inclination characteristic G401, and determines the first inclination K1 by using the value V1.

Also, the command value calculation unit 202 corrects a deceleration inclination characteristic G501 by determining the second inclination K2 similarly to the first inclination K1. That is, as the actual slewing speed decreases, the command value calculation unit 202 translates the deceleration inclination characteristic G501 shown in FIG. 6 in a direction indicated by an arrow D5 to decrease a value V2, and corrects the deceleration inclination characteristic G501. Then, the command value calculation unit 202 determines the value V2 by using the corrected deceleration inclination characteristic G501, and determines the second inclination K2 by using the value V2. However, in the corrected deceleration inclination characteristics G401 and G501, a relationship of V1>V2 is maintained. Therefore, the period TA1 of a free-run state is shortened.

When the actual slewing speed is low, even if the actual slewing speed is gently decreased, the time until the upper slewing body 3 stops can be kept within a certain time. Therefore, there is no problem even if the first and second inclinations K1 and K2 are gentle. Therefore, as the actual slewing speed decreases, the present embodiment reduces the first and second inclinations K1 and K2, stops the upper slewing body 3 more smoothly, and improves riding comfort and safety.

Here, as a relationship between correction amounts of the deceleration inclination characteristics G401 and G501 and the actual slewing speed, for example, a relationship that the correction amounts decrease linearly, quadratically, or monotone decreasing functionally as the actual slewing speed decreases can be employed.

Note that in the second embodiment, as the actual slewing speed decreases, the first and second inclinations K1 and K2 become gentle, but this is one example. For example, if a construction machine 1 is located on a sloping ground, the first and second inclinations K1 and K2 may be changed in accordance with an inclination angle of the sloping ground with respect to the horizontal plane.

For example, it is considered that, as the construction machine 1 is located on a sloping ground at a greater inclination angle, inertial energy of the upper slewing body 3 in a free-run state will increase. To implement this, a slewing control device is required at least to include an inclination angle sensor for detecting the inclination angle of the construction machine 1. Then, as the inclination angle detected by the inclination angle sensor increases, the command value calculation unit 202 may correct the deceleration inclination characteristics G401 and G501 more in a direction in which the values V1 and V2 increase, and may determine the first and second inclinations K1 and K2 by using the corrected values V1 and V2. Accordingly, as the inertial energy of the upper slewing body 3 increases, the period TA1 of a free-run state is shortened, and safety and riding comfort can be improved.

Third Embodiment

The third embodiment increases first and second inclinations K1 and K2 as a length of a work device on a slewing plane of an upper slewing body 3 increases. In the present embodiment, a slewing control device further includes a posture detection unit 120 for detecting a posture of a work device 4 as shown in FIG. 2.

The posture detection unit 120 includes an angle sensor for detecting a rise and fall angle of a boom 15 with respect to the upper slewing body 3, an angle sensor for detecting a swing angle of an arm 16 with respect to the boom 15, and an angle sensor for detecting a swing angle of a bucket 17 with respect to the arm 16. Also, in the present embodiment, it is assumed that lengths of the boom 15, the arm 16, and the bucket 17 are known.

Assuming that the lengths of the boom 15, the arm 16, and the bucket 17 are known, if the swing angles of the boom 15, the arm 16, and the bucket 17 are known, a length of the work device 4 on the slewing plane can be calculated using trigonometric functions. Here, the slewing plane refers to a plane orthogonal to a rotation axis of the upper slewing body 3.

Inertial energy of the upper slewing body 3 increases as the length of the work device 4 on the slewing plane increases. Therefore, in this case, considering safety and riding comfort of a construction machine 1, it is preferable to shorten the period TA1 in a free-run state.

Therefore, in the present embodiment, a command value calculation unit 202 calculates the length of the work device 4 on the slewing plane from the swing angle of each of the boom 15, the arm 16, and the bucket 17 detected by the posture detection unit 120. Then, as the length of the work device 4 on the slewing plane increases, the command value calculation unit 202 corrects deceleration inclination characteristics G401 and G501 in a direction in which values V1 and V2 increase (direction opposite to the direction indicated by an arrow D4 and the direction indicated by an arrow D5). Then, the command value calculation unit 202 may determine the first and second inclinations K1 and K2 by using the corrected values V1 and V2. Here, as a relationship between a correction amount of the deceleration inclination characteristic and the length of the work device 4 on the slewing plane, a relationship can be employed in which, as the length of the work device 4 on the slewing plane increases, the correction amount increases, for example, linearly, quadratically, or monotone increasing functionally.

Thus, according to the present embodiment, as the length of the work device 4 on the slewing plane increases, the first and second inclinations K1 and K2 are steepened, deceleration torque can be provided to the upper slewing body 3 more quickly and the upper slewing body 3 can be stopped promptly.

Note that since the deceleration inclination characteristics G401 and 0501 have constant values V1 and V2 regardless of the operation amount, the slewing control device may store only the values V1 and V2 in a ROM.

Conclusion of Embodiment

A slewing control device according to one aspect of the present invention is a slewing control device for a construction machine including a slewing body and an operation unit to which an operation for slewing the slewing body is input. The slewing control device includes:

a slewing motor configured to drive the slewing body to slew;

a slewing inverter configured to drive the slewing motor;

a speed detection unit configured to detect an actual slewing speed of the slewing motor;

an operation amount detection unit configured to detect an operation amount that is input into the operation unit;

a target speed calculation unit configured to calculate a target speed according to the operation amount;

a command value calculation unit configured to calculate a slewing command value to cause the actual slewing speed to reach the target speed late at a predetermined inclination; and a drive unit configured to calculate a torque command value to cause a deviation between the slewing command value and the actual slewing speed to become zero and to output the torque command value to the slewing inverter.

The drive unit:

stops outputting the torque command value regardless of the deviation in a first state where the slewing command value is equal to or greater than the actual slewing speed in a state where the operation amount detection unit detects operation input of slewing stop; and outputs the torque command value in a second state where the slewing command value is less than the actual slewing speed in the state where the operation amount detection unit detects the operation input of the slewing stop.

The command value calculation unit decreases the slewing command value over time at a first inclination in the first state, and decreases the slewing command value over time at a second inclination that is gentler than the first inclination in the second state.

According to the present aspect, in the first state where the slewing command value is equal to or greater than the actual slewing speed during the operation input indicating slewing stop, the output of the torque command value to the slewing inverter is stopped regardless of the deviation. Therefore, the slewing body goes into a free-run state.

However, according to the present aspect, in the first state, the slewing command value decreases over time at the first inclination. Here, the first inclination has a greater inclination than the second inclination, which is the inclination of the slewing command value after this period elapses. Therefore, the period in which the slewing body is in a free-run state can be shortened. Meanwhile, after this period elapses, the slewing command value decreases at the second inclination that is gentler than the first inclination, and thus the slewing body can be stopped smoothly.

According to the present aspect, the command value calculation unit may make the first and second inclinations gentle as the actual slewing speed decreases.

When the actual slewing speed is low, the time until the slewing body stops can be kept within a certain time even if the actual slewing speed is gently decreased.

According to the present aspect, as the actual slewing speed decreases, the first and second inclinations are made gentle. This makes it possible to stop the slewing body smoothly while keeping the time until the slewing body stops within a certain time.

According to the present aspect, the construction machine may further include a work device attached to the slewing body with a changeable posture, the slewing control device may further include a posture detection unit configured to detect the posture of the work device, and the command value calculation unit may calculate a length of the work device on a slewing plane of the slewing body from the posture detected by the posture detection unit, and may increase the first and second inclinations as the calculated length increases.

As the length of the work device on the slewing plane of the slewing body increases, the inertia of the slewing body increases, and thus the time from the input of the slewing stop operation until the slewing body stops is prolonged. According to the present aspect, as the length of the work device on the slewing plane increases, the first and second inclination are steepened, making it possible to provide the slewing body with decelerating torque more quickly, and to stop the slewing body promptly.

According to the present aspect, the drive unit may calculate the torque command value to cause the deviation to become zero by proportional control.

In proportional control, the actual slewing speed is likely to maintain a speed lower than the target speed due to residual deviation. If the slewing stop operation is input under this situation, the slewing command value becomes higher than the actual slewing speed for a while from this operation input. According to the present aspect, as described above, the slewing command value decreases at the first inclination in the first state, making it possible to shorten the period of a free-run state that is predicted to occur frequently when proportional control is applied.

The invention claimed is:

1. A slewing control device, for a construction machine including a slewing body and an operation unit, to which an operation for slewing the slewing body is input, the slewing control device comprising:

a slewing motor configured to drive the slewing body to slew;

a slewing inverter configured to drive the slewing motor;

a speed sensor configured to detect an actual slewing speed of the slewing motor;

an operation amount detector configured to detect an operation amount that is input into the operation unit; and a controller comprising:

a target speed calculation unit configured to calculate a target speed according to the operation amount;

a command value calculation unit configured to calculate a slewing command value to cause the actual slewing speed to decrease toward the target speed; and a drive unit configured to calculate a torque command value to cause a deviation between the slewing command value and the actual slewing speed to become zero and to output the torque command value to the slewing inverter, wherein the drive unit:

stops outputting the torque command value regardless of the deviation in a first state where the slewing command value is equal to or greater than the actual slewing speed in a state where the operation amount detector detects operation input of slewing stop, whereby the slewing body goes into a free-run state of slewing by inertial energy;

outputs the torque command value in a second state where the slewing command value is less than the actual slewing speed in the state where the operation amount detector detects the operation input of the slewing stop, whereby the slewing body comes out of the free-run state, and the command value calculation unit decreases the slewing command value over time at a slope of a first inclination of the slewing command value in the free-run state, and decreases the slewing command value over time at a slope of a second inclination of the slewing command value that is smaller than the first inclination in the second state.

2. The slewing control device according to claim 1, wherein the command value calculation unit makes the slopes of the first and second inclinations smaller as the actual slewing speed decreases.

3. The slewing control device according to claim 1, wherein the construction machine further includes a work device attached to the slewing body with a changeable posture, the slewing control device further comprises a posture detector that includes an angle sensor and is configured to detect the posture of the work device, the command value calculation unit calculates a length of the work device on a slewing plane of the slewing body from the posture detected by the posture detector, and increases the first and second inclinations as the calculated length increases.

4. The slewing control device according to claim 1, wherein the drive unit calculates the torque command value to cause the deviation to become zero by proportional control.

* * * * *